United States Patent [19]

Khaidurov et al.

[11] 3,965,604

[45] June 29, 1976

[54] FIRING AND TRIGGER MECHANISM FOR SELF-LOADING MATCH PISTOL

[76] Inventors: Efim Leontievich Khaidurov, ulitsa Glagoleva, 25, korpus 2, kv. 138, Moscow; Vladimir Alexandrovich Razorenov, ulitsa Ponomareva, 4-a, kv. 51, Minsk, both of U.S.S.R.

[22] Filed: Aug. 22, 1974

[21] Appl. No.: 499,847

[52] U.S. Cl. ..... 42/69 B; 89/145

[51] Int. Cl.[2] ..... F41C 19/00

[58] Field of Search ..... 42/69 B, 69 R; 89/145, 89/144, 139

[56] References Cited

UNITED STATES PATENTS

| | | | |
|---|---|---|---|
| 2,775,837 | 1/1957 | Perry et al. | 42/69 R |
| 2,855,716 | 10/1958 | Campbell | 42/69 B |
| 2,858,741 | 11/1958 | Simpson | 42/69 B |
| 3,264,939 | 8/1966 | Reising | 89/145 |
| 3,662,483 | 5/1972 | Seecamp | 42/69 B |

*Primary Examiner*—Charles T. Jordan

*Attorney, Agent, or Firm*—Haseltine, Lake & Waters

[57] ABSTRACT

A firing and trigger mechanism for increasing the accuracy of firing in which a hammer and a firing spring are held in a cocked position and in engagement with one arm of a bell crank. The other arm of the bell crank is engaged by a hammer catch that is connected with a trigger through a triggering rod resiliently urged to the hammer catch. The bell crank is resiliently urged against the hammer and the hammer catch by a spring, having one end bearing against the hammer catch. With the hammer in a cocked position, the spring urges the hammer catch against the bell crank, and as the latter are brought out of engagement, the bell crank loads the spring with an additional force that compensates for the friction forces between the bell crank and the hammer catch. These forces disappear when the bell crank and the hammer catch are disengaged. The spring allows the pressure on the trigger to be maintained substantially constant until the moment the bell crank is disengaged from the hammer catch, and after they have been disengaged.

2 Claims, 6 Drawing Figures

FIRING AND TRIGGER MECHANISM FOR SELF-LOADING MATCH PISTOL

BACKGROUND OF THE INVENTION

The present invention relates to match firearms, and, more particularly, it relates to firing and trigger mechanisms for self-loading match pistols.

There are already known match pistols wherein the firing and trigger mechanism includes a hammer associated with the firing spring and retained in a cocked position by a bell crank of which one end is engaged by the hammer and the other end bears against the sear notch of the hammer catch. The hammer catch is connected through a triggering rod resiliently biased thereto to the trigger.

The bell crank is biased against the hammer when the latter is cocked. The spring biasing the bell crank against the hammer has one end connected to the bell crank and the other end secured to the pistol frame.

To limit the length of the idle motion of the trigger (i.e. the motion after the hammer catch has released the bell crank), the base of the trigger, by which the latter is suspended from the frame, has mounted thereon an adjustment screw positioned so that a clearance is left intermediate the end of this screw and the frame, this clearance being taken up at the moment when the hammer catch is withdrawn from under the hammer (see, for example, USSR Inventor's Certificate No. 102,355, Int. Cl. F 41 c 19/00).

A disadvantage of this known firing and trigger mechanism is that when the bell crank and the hammer catch are disengaged, at the moment of their disengagement there is experienced by the sportsman the so-called "trigger drop". As the trigger is being depressed or pulled, there is applied thereto an effort which has to counterbalance the effort of the springs and the forces of friction between the sear notch of the hammer catch and the arm of the bell crank, engaging this notch. The moment the hammer catch and the bell crank are disengaged, the force of friction therebetween drops to zero, which means that the "trigger drop" is experienced, and this might result in jerking of the pistol, and, consequently, in poorer accuracy of firing.

It is an object of the present invention to create a firing and trigger mechanism for a self-loading match pistol, wherein the effort of pulling the trigger prior to the moment of disengagement of the bell crank and the hammer catch and after their disengagement should be maintained practically permanent.

SUMMARY OF THE INVENTION

With this and other objects in view, there is herein disclosed a firing and trigger mechanism for a self-loading match pistol, wherein the hammer associated with the firing spring is retained in a cocked position by engagement with one arm of a bell crank resiliently biased thereagainst, the other arm of this bell crank engaging a hammer catch connected through a triggering rod resiliently biased thereagainst to the trigger, in which pistol, in accordance with the present invention, the resilient bias of the bell crank against the hammer is effected by a spring of which one end bears upon the bell crank and the other end bears upon the hammer catch, so that with the hammer cocked this spring urges the hammer catch to the bell crank, and when the latter two are disengaged, the bell crank loads the spring with an additional effort to compensate for the loss of the forces of friction between the bell crank and the hammer catch at the moment of their disengagement.

It is advisable that the spring acting upon the bell crank and the hammer catch should be a torsion spring and that this torsion spring should be mounted about the axis of rotation of the hammer catch.

The employment of the torsion spring is both structurally simple and dependable in operation.

A firing and trigger mechanism for a self-loading match pistol, constructed in accordance with the present invention, eliminates the "trigger drop" by maintaining practically constant effort of pulling the trigger both prior to the moment of disengagement of the bell crank and the hammer catch and after their disengagement, and, consequently, promotes better firing accuracy.

The said and other objects and advantages of the present invention will become apparent from the following description of an embodiment of a firing and trigger mechanism for a self-loading match pistol in accordance with the invention, with reference being had to the accompanying drawings, wherein:

DESCRIPTION OF THE PREFERRED EMBODIMENTS

Figures 1, 5, 6:
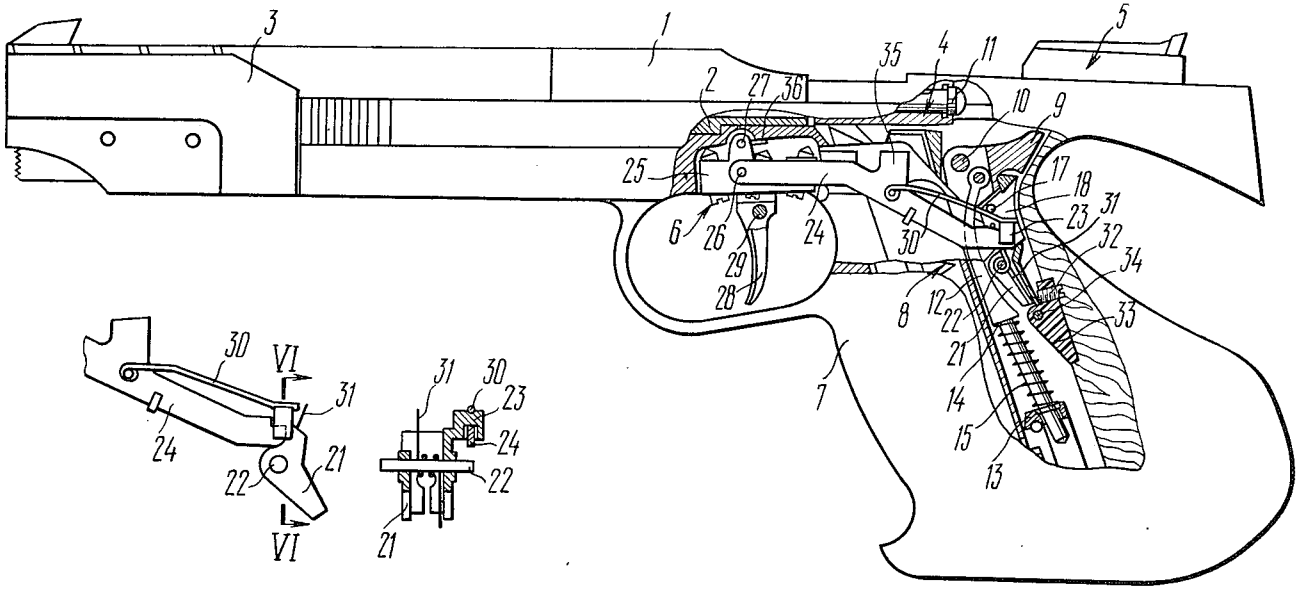
FIG. 1 is a general partly broken away view of a self-loading match pistol, showing a firing and trigger mechanism in accordance with the invention.
FIG. 5 shows schematically the triggering rod connected to the hammer catch.
FIG. 6 is a sectional view along line VI—VI in FIG. 5.

Referring now to the drawings, the self-loading match pistol includes a frame 1 (FIG. 1) supporting thereon a barrel 2 with a compensator 3. The frame 1 also has mounted thereon a breechblock or slide 4, a sighting device 5 and a firing and trigger mechanism 6. The grip 7 receives therein a magazine 8.

The firing and trigger mechanism 6 includes, in its turn, a hammer 9 (FIGS. 1, 2, 3 and 4) pivotable about an axis 10 mounted on the frame 1 (FIG. 1). To be able to strike the firing pin of the breechblock 4, the hammer 9 is connected to a plunger 12 of which the bottom end passes through a hole in the lock 13 of the magazine 8. Received about the plunger 12 and clamped between its shoulder 14 and the external surface of the lock 13 is a firing spring 15. The hammer 9 is provided with a cam rib 16 (FIGS. 2 and 4) of which the surface is equidistant from the axis 10 of pivoting of the hammer 9.

The frame 1 (FIG. 1) has also mounted thereon a pivot pin 17 on which a bell crank 18 is mounted for pivoting motion. This bell crank has one arm thereof in engagement with the sear notch 19 (FIG. 4) of the hammer 9, while its other arm engages the sear notch 20 of the hammer catch 21 (in the present disclosure the sear notches of the hammer 9 and hammer catch 21 are their respective surfaces cooperating with the corresponding surfaces of the bell crank 18).

The hammer catch 21 is pivotable on the frame 1 (FIG. 1) about a pivot pin 22 and has a lug 23 (FIGS. 1, 3, 5, 6) with a groove adapted to receive therein the end of a triggering rod 24 (FIG. 6). The opposite end of the triggering rod 24 is pivotably mounted on a base 25 (FIG. 1) by means of a pivot pin 26. The base 25, in its turn, is pivotable about a pin 27 supported by the frame 1. The base 25 has mounted thereon a trigger 28 which is thus pivotable jointly with the base 25 about the pivot pin 27. A screw 29 fixes the trigger 28 on the base 25. The triggering rod 24 is urged to the hammer catch 21 by a torsion spring 30.

Figure 4:
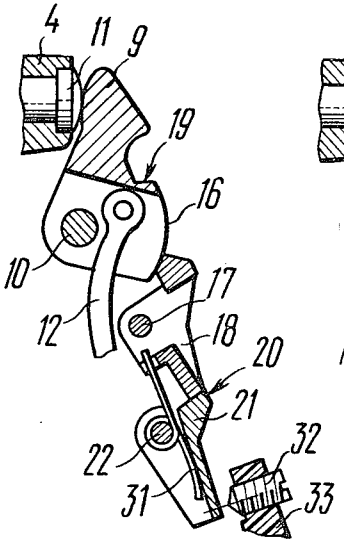
FIG. 4 shows schematically the hammer catch, the bell crank and the hammer after the hammer has been released.
Figure 3:
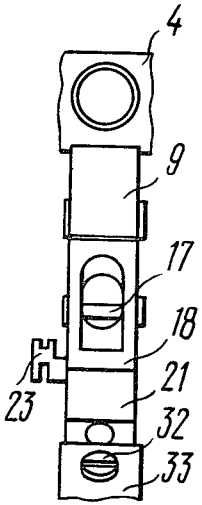
FIG. 3 is a view taken along arrow A in FIG. 2.

The pivot pin 22 (FIGS. 1, 2, 4) of the hammer catch 21 has mounted thereabout a spring 31 which is also a torsion spring. This spring 31 has one end thereof bearing upon the bell crank 18 and the other end thereof bearing upon the hammer catch 21. With the hammer 9 cocked, the spring 31 urges the hammer catch 21 for the sear notch 20 of the latter to engage the corresponding surface of the bell crank 18 and also urges the bell crank 18 to the sear notch 19 of the hammer 9. When the trigger 28 (FIG. 1) is pulled, at the moment of disengagement of the hammer catch 21 (FIG. 4) from the bell crank 18, the latter, upon having released the hammer 9, engages the cam rib 16 of the hammer 9, as can be seen in FIG. 4, and thus loads the spring 31 with an additional effort compensating for the loss of the forces of friction appearing when the bell crank 18 moves relative to the hammer catch 21 and disappearing when the sear notch 20 of the hammer catch 21 is disengaged from the corresponding surface of the bell crank 18. This compensation of the forces of friction eliminates the "trigger drop", i.e. the finger of the sportsman feels permanent resistance to the pulling effort applied to the trigger 28 both prior to the disengagement of the bell crank 18 from the hammer catch 21 and after their disengagement.

Alternatively, it is possible to employ for the spring urging the bell crank and the hammer catch an extension spring having one end thereof connected to the hammer catch and the other end connected to the bell crank.

To offer adjustment of the length of engagement of the bell crank 18 (FIG. 2) and the sear notch 20 of the hammer catch 21, there is provided a screw 32 threadedly received in an insert 33 secured by a pin 34 (FIG. 1) on the frame 1.

The herein disclosed firing and trigger mechanism for a self-loading match pistol operates, as follows.

In a cocked position the hammer 9 has its sear notch 19 engaging the bell crank 18 bearing upon the sear notch 20 of the hammer catch 21. The firing spring 15 is compressed by the plunger 12 of the hammer 9 and biases the hammer 9 in the direction of disengagement from the bell crank 18.

As the trigger 28 is being pulled, the base 25 is pivoted about the pin 27 and draws backwardly (in the drawings) the triggering rod 24 which exerts an action upon the lug 23 of the hammer catch 21, whereby the latter is pivoted about the pin 22, overcoming the force of friction between the sear notch 20 of the hammer catch 21 and the corresponding surface of the bell crank 18, until the sear notch 20 of the hammer catch 21 is drawn from under the bottom (in the drawing) arm of the bell crank 18.

Thereafter the hammer 9 is actuated by the plunger 12 urged by the now extending firing spring 15 and pivots about the pin 10, thus starting to disengage itself from the top (in the drawing) arm of the bell crank 18 and to rotate the latter through a specified angle.

While being thus pivoted by the action exerted thereupon by the hammer 9, the bell crank 18 loads the spring 31 with the additional effort and retains this state as long as its top (in the drawing) arm slides along the rib 16 of the still rotating hammer 9, until the latter strikes the firing pin 11 of the breechblock 4. The additional effort applied to the spring 31 is transmitted through the hammer catch 21, the triggering rod 24, the base 25 and the trigger 28 to the finger of the sportsman.

With this additional effort being applied to the trigger 28, the "trigger drop" is eliminated, i.e. this effort compensates for the sharp drop of the resistance of the trigger upon the disengagement of the hammer catch 21 from the bell crank 18.

Upon the hammer 9 having striken the firing pin 11 a shot is fired, and the breechblock is thrown into its extreme backward position to cock the hammer 9 and to act upon a disengaging lug 35 which latter brings the triggering rod 24 out of the engagement with the lug 23 of the hammer catch 21.

Figure 2:
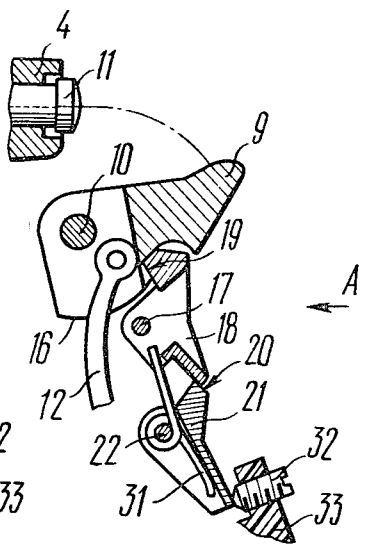
FIG. 2 shows schematically the hammer catch, the bell crank and a hammer in a cocked position, an enlarged view.

Under the action of the spring 31 the bell crank 18 and hammer catch resume the position which they had occupied before the firing, as can be seen in FIG. 2.

To fire a successive shot, it is necessary first to release the trigger 28. Upon the trigger 28 having been released, the spring 36 returns the base 25 into its initial position, and the triggering rod 24 re-engages the lug 23 of the hammer catch 21. This completes the operating cycle of the herein disclosed firing and trigger mechanism, and the pistol is prepared for firing another shot.

What we claim is:

1. A firing and trigger mechanism for a self-loading match pistol mounted in a frame thereof; comprising: a hammer pivotably mounted on said frame of said pistol; a plunger operatively connected with said hammer; a firing spring received about said plunger; a bell crank pivotably mounted on said frame of said pistol; a hammer catch pivotably mounted on said frame of said pistol; said bell crank when in a cocked position of said hammer having one arm thereof engaging said hammer and having another end engaging said hammer catch; a spring having one end thereof bearing upon said bell crank and another end thereof bearing upon said hammer catch; a trigger pivotably mounted on said frame of said pistol; a triggering rod having one end thereof operatively connected with said trigger and having another end thereof operatively connected with said hammer catch and being resiliently urged to said hammer catch by auxiliary spring means; said spring being arranged so that one end thereof bears upon said bell crank and the other end thereof bears upon said hammer catch and with said hammer in a cocked position said spring urges said bell crank to said hammer and to said hammer catch, upon disengagement of said hammer catch and said bell crank said bell crank loading said spring with an additional force compensating for the loss of the force of friction between said bell crank and said hammer catch, and disappearing at the moment of disengagement of said hammer catch and said bell crank.

2. A firing and trigger mechanism as claimed in claim 1, wherein said spring urging said bell crank and said hammer catch is a torsion spring mounted on the pivot pin of said hammer catch.

* * * * *